310-13 SR
FIP8502 XR 4,236,130

United States Patent [19]
Hubert

[11] 4,236,130
[45] Nov. 25, 1980

[54] SOLENOID ACTUATOR HAVING A LONG STROKE

[76] Inventor: Gustav Hubert, 8427 Leroy St., San Gabriel, Calif. 91775

[21] Appl. No.: 945,553

[22] Filed: Sep. 25, 1978

[51] Int. Cl.[3] ..... H01F 7/08
[52] U.S. Cl. ..... 335/223; 310/13; 335/279
[58] Field of Search ..... 335/222, 223, 224, 225, 335/231, 279, 282; 310/13, 14, 27

[56] References Cited

U.S. PATENT DOCUMENTS

| | | | |
|---|---|---|---|
| 473,538 | 4/1892 | Weston | 335/279 X |
| 901,974 | 10/1908 | Lindsey | 335/231 |
| 1,199,921 | 10/1916 | Poth | 335/223 |
| 3,070,730 | 12/1962 | Gray et al. | 335/231 |
| 3,467,925 | 9/1969 | Masuda | 335/222 X |
| 3,525,963 | 8/1970 | Burdett | 335/279 X |
| 3,676,758 | 7/1972 | Mathews | 310/27 |
| 3,746,937 | 7/1973 | Koike | 310/13 |
| 3,786,383 | 1/1974 | Ludwig et al. | 335/231 |

OTHER PUBLICATIONS

Text-Electro Magnetic Devices by Herbert C. Roters, 1941, pp. 238-240 and 317.

*Primary Examiner*—George Harris
*Attorney, Agent, or Firm*—Christie, Parker & Hale

[57] ABSTRACT

A solenoid comprises an electric coil having an opening through it and an armature of permeable material having in fixed relative relationship a core passing through the opening of the coil and a sleeve surrounding the coil. The armature is unmagnetized except for magnetization induced by current flow through the coil. The coil and the armature are relatively movable in an axial direction to vary the extent of overlap therebetween. A pole piece of permeable material connects the sleeve to the core at one end. A pole piece of permeable material is fastened to the end of the coil opposite to the first named pole piece. In one embodiment the core is movable relative to the sheath prior to energization of the coil, to permit the coil to be preset to one of two positions in gapless relationship with the sheath.

11 Claims, 4 Drawing Figures

SOLENOID ACTUATOR HAVING A LONG STROKE

BACKGROUND OF THE INVENTION

This invention relates to solenoids and, more particularly, to a solenoid actuator having a long stroke.

Solenoids are employed as actuators in many different fields of industry. A typical solenoid comprises an electric coil, a sleeve of permeable material surrounding the coil and covering one end thereof, leaving the other end thereof open, and a plunger or core of permeable material lying inside the coil. When the solenoid is unenergized, the plunger is biased by a spring or other similar means so as to protrude from the open end of the coil, leaving an air gap between the plunger and the closed end of the coil. When the solenoid is energized by connecting a source of electrical energy to the coil, there is induced around the coil a magnetic field that draws the plunger into the coil and reduces the air gap.

An important operating characteristic of a solenoid is its stroke, i.e., the distance of travel of the plunger when the solenoid is energized, as depicted by a graph of force on the plunger versus displacement of the plunger from its energized position. Due to the variable air gap in the described conventional solenoid, the force exerted on its plunger decreases rapidly with displacement and, accordingly, its stroke is very limited.

SUMMARY OF THE INVENTION

According to the invention, a solenoid comprises an electric coil having an opening through it and an armature of permeable material having in fixed relative relationship a core passing through the opening of the coil and a sleeve surrounding the coil. The armature is unmagnetized, except for magnetization induced by current flowing through the coil. The coil and the armature are relatively movable in an axial direction to vary the extent of overlap therebetween. Consequently, as the coil moves axially relative to the armature, the air gap between the core and the sleeve and thus the reluctance of the magnetic circuit of the solenoid remains more constant and lower. More force is available at larger displacement, resulting in a solenoid with a longer stroke than the conventional solenoid design.

A feature of the invention is an armature in which the sleeve and core are connected by an integral pole piece of permeable material that encloses one end of the coil. Another pole piece is preferably fixed to the other end of the coil to provide a sudden drop in reluctance as the solenoid approaches its energized state.

In one embodiment of the invention, the core is axially movable within the sleeve between two fixed positions relative to the sleeve prior to energization of the solenoid. By presetting the core in one or the other of the fixed positions, the coil when energized also moves into one of two positions determined by the position of the core.

BRIEF DESCRIPTION OF THE DRAWINGS

The features of specific embodiments of the best mode contemplated of carrying out the invention, are illustrated in the drawings, in which.

DETAILED DESCRIPTION OF THE SPECIFIC EMBODIMENTS

Figure 1:
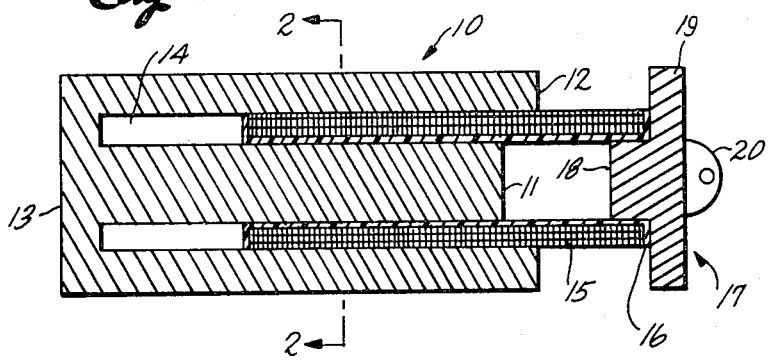
FIG. 1 is a side sectional view of a solenoid actuator incorporating the principles of the invention.
Figure 2:
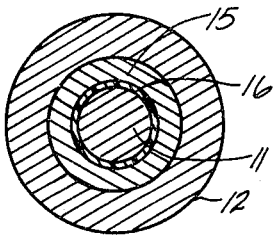
FIG. 2 is a sectional view of the solenoid actuator of FIG. 1 taken through a plane designated 2—2.

In FIGS. 1 and 2, an armature 10 has in a one piece construction of permeable material, such as soft iron, a cylindrical core 11, a hollow cylindrical sheath or sleeve 12 surrounding core 11, and a circular disc-shaped pole piece 13 connecting core 11 and sleeve 12 at one end. An annular space 14 is formed between core 11 and sleeve 12. An electric coil 15 made of suitably insulated electrically conductive wire, is wound on an electrically insulative bobbin 16. A pole piece 17 comprises in a one piece construction made of permeable material a circular disc-shaped portion 18 having a small diameter designed to fit inside bobbin 16, a circular disc-shaped portion 19 having a large diameter approximately equal to the outer diameter of sleeve 12, and a fitting 20. Portion 18 is bonded in place inside bobbin 16, portion 19 lies adjacent to the end of sleeve 12 opposite from pole piece 13, and fitting 20 is available for connection to a linkage that transmits movement of coil 15 to a device to be actuated. Bobbin 16 fits around core 11 with a small clearance and sleeve 12 fits around the outer surface of coil 15 with a small clearance. Coil 15, bobbin 16, and pole piece 17 move axially as a unit with respect to armature 10 in and out of annular space 14. Armature 10 is unmagnetized except for the magnetization induced by current flowing through coil 15.

Figure 3:
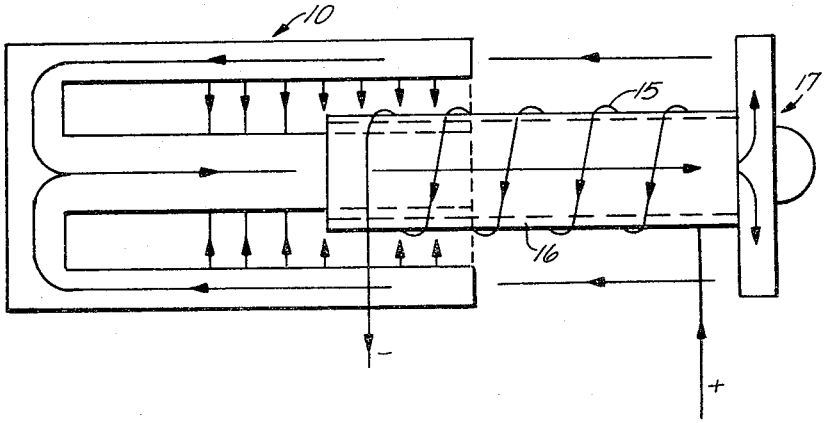
FIG. 3 is a simplified side view of the solenoid actuator of FIG. 1 illustrating the magnetic circuit.

As depicted in FIG. 3, when coil 15 is energized by the flow of current therethrough in either direction, a magnetic field is induced around coil 15. The flux of the magnetic field passes from sleeve 12 to core 11 through the small constant air gap, i.e., annular space 14, and through pole piece 13 as coil 15 moves axially relative to armature 10. The flux passing through annular space 14 and the flow of current through coil 15, which is perpendicular thereto, give rise to a force on coil 15 (left hand rule) that draws coil 15 into annular space 14. As coil 15 moves axially into annular space 14 and approaches its energized position, the air gap between pole piece 17 and the end of sleeve 12 becomes sufficiently small to provide an additional force due to the sudden drop in reluctance that aids in moving coil 15 to its energized position. If desired, pole piece 17 could also serve as a stop on the movement of coil 15, thereby determining the energized position of coil 15 when armature 10 and coil 15 completely overlap.

Core 11 and sleeve 12 are stationary relative to each other. Preferably as shown, they are joined at one end to form a gapless magnetic circuit by means of pole piece 13. However, in some embodiments a small gap between core 11 and sleeve 12 could be tolerated, albeit at the expense of the solenoid stroke length. In either case, the gap length between core 11 and sleeve 12 remains constant as the solenoid is energized.

Figure 4:
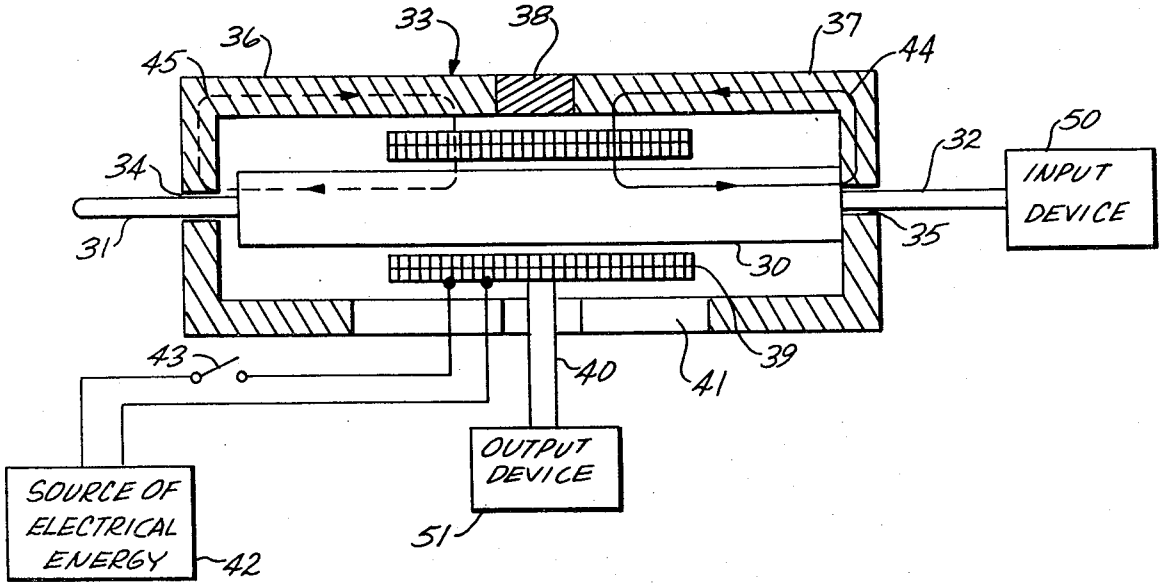
FIG. 4 is a side sectional view of a two-position solenoid actuator incorporating the principles of the invention.

In FIG. 4, a cylindrical core 30 of permeable material has fixed to its respective ends rods 31 and 32. Core 30 lies inside a hollow sleeve 33 that is somewhat longer than core 30. Sleeve 33 has openings 34 and 35 at its respective ends through which rods 31 and 32 pass. Thus, core 30 is free to move axially back and forth within sleeve 33. Sleeve 33 comprises identical hollow cylinders 36 and 37 of permeable material closed at one end, open at the other end, and joined at their open ends by a band 38 of nonmagnetic material. Cylinders 36 and 37 could be joined to band 38 for example by an adhesive. A movable electric coil 39, which could be mounted on a bobbin, not shown, fits around core 30 with a small clearance. Sleeve 33 surrounds the outer surface of coil 39 with a small clearance to minimize the gap therebetween. A rod 40, which is fastened at one end to coil 39, extends through a central, axially extending slot 41 formed in sleeve 33. A source of electrical energy 42 is connected through a switch 43 to the terminals of coil 39. Rods 31 and 32 serve to support core 30 and guide it during axial movement. Core 30 serves to support coil 39 and guide it during axial movement.

Rod 31 and/or rod 32 serve as the input to the solenoid actuator of FIG. 4 and rod 40 serves as the output thereof. In operation, rod 31 and/or rod 32 is moved axially by an input device 50 until core 30 abuts one end of sleeve 33 or the other, i.e., the right hand end in FIG. 4. At this point, core 30 is in fixed relationship relative to sleeve 33. Then, switch 43 is closed to energize coil 39. Regardless of the direction of current flow through coil 39, the magnetic field induced by coil 39 causes coil 39 to move in the same direction as core 30, i.e., to the right in FIG. 4. The movement of coil 39 is transmitted by rod 40 to an output device 51 to be actuated.

Instead of presetting core 30 against one end or the other of sleeve 33 before energizing coil 39, core 30 could be moved only slightly off center toward one end or the other of sleeve 33 before energizing coil 39. Any such offset would result in a smaller reluctance in the magnetic circuit including the corresponding half of sleeve 33, i.e. the magnetic circuit designated 44 in FIG. 4 than in the other half of sleeve 33, i.e. the magnetic circuit designated as 45 in FIG. 4. This imbalance in reluctance increases the flux in the magnetic circuit having a smaller reluctance and thus pulls core 30 up against the corresponding end of sleeve 33.

The solenoid actuator disclosed in FIG. 4 has many applications. One such application is as an amplifier—the movement of rod 31 and/or 32 is amplified at rod 40.

It should be noted that the actuator of FIG. 1 and the actuator of FIG. 4 are not polarity sensitive, i.e. the coil moves towards the closed end of the sleeve regardless of the direction of current flow through the coil, because the armature is unmagnetized except for the magnetization induced by current flow through the coil.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, the core, coil, and sleeve could have other cross-sectional configurations, i.e. oblong or square. Either the armature or the coil could be fixed while the other is movable.

What is claimed is:

1. A solenoid comprising:

electric coil means for producing a magnetic field, the coil means having windings forming an opening through the coil; and an armature of permeable material having in fixed relative relationship a core passing through the opening of the windings and a sleeve surrounding the coil means;

the armature being unmagnetized except for magnetization induced by current flow through the coil means;

all the windings of the coil means and the armature being relative movable with respect to each other in an axial direction to vary the extent of overlap therebetween.

2. The solenoid of claim 1, in which the armature additionally comprises an armature pole piece of permeable material directly connecting the core and the sleeve to form a gapless magnetic circuit therebetween.

3. The solenoid of claim 2, in which the core, the sleeve, and the pole piece have a one piece construction.

4. The solenoid of claim 3, in which the coil means and the armature are sufficiently movable relative to each other to overlap completely and additionally comprising a coil pole piece fastened to the end of the coil means opposite to the armature pole piece, the coil pole piece extending radially outward from the end of the coil means to form a stop on the movement of the coil means relative to the armature.

5. The solenoid of claim 1, additionally comprising a coil pole piece fastened to one end of the coil means, the pole piece extending radially outward so as to lie adjacent to one end of the sleeve.

6. A solenoid actuator comprising an electric coil, a source of electrical energy, means for connecting the source to the coil to induce a magnetic field therein, a core of permeable material lying inside the coil, the core and the coil being axially movable relative to each other, and a sleeve of permeable material around the coil, characterized in that the core and the sleeve are joined at one end of the coil to form a gapless magnetic circuit therebetween, and the sleeve and the core are magnetized only by the current flowing through the coil.

7. A solenoid actuator comprising:

a sleeve having first and second cylindrical portions of permeable material closed at one end and a connecting band of nonmagnetic material between the cylindrical portions;

a core of permeable material inside the sleeve, the core being shorter than the sleeve;

means for supporting the core for back and forth axial movement between the closed ends of the sleeve; and a movable electrical coil around the core inside the sleeve, the coil being shorter than the core.

8. The solenoid actuator of claim 7, in which the supporting means comprises openings in the respective ends of the sleeve and rods fastened to the ends of the core and extending through the respective openings.

9. The solenoid actuator of claim 8, additionally comprising means for moving one or both of the rods axially to preset the core.

10. The solenoid actuator of claim 7, additionally comprising a central axial slot in the sleeve and a rod fastened at one end to the coil and extending through the slot.

11. The solenoid actuator of claim 10, additionally comprising an output member to be actuated connected to the rod.

* * * * *